US009016361B2

(12) United States Patent
Donohoe

(10) Patent No.: US 9,016,361 B2
(45) Date of Patent: Apr. 28, 2015

(54) WELLHEAD FOR A HYDROCARBON-PRODUCING WELLBORE

(75) Inventor: Nicholas Donohoe, Edmonton (CA)

(73) Assignee: 1238585 Alberta Ltd., Lloydminster (CA)

( * ) Notice: Subject to any disclaimer, the term of this patent is extended or adjusted under 35 U.S.C. 154(b) by 336 days.

(21) Appl. No.: 13/344,496

(22) Filed: Jan. 5, 2012

(65) Prior Publication Data

US 2012/0175102 A1 Jul. 12, 2012

(30) Foreign Application Priority Data

Jan. 10, 2011 (CA) ..... 2727514

(51) Int. Cl.
*E21B 19/00* (2006.01)
*E21B 33/035* (2006.01)
*E21B 43/01* (2006.01)

(52) U.S. Cl.
CPC ..... *E21B 33/035* (2013.01); *E21B 43/0122* (2013.01)
USPC ..... 166/81.1; 166/91.1

(58) Field of Classification Search
CPC ..... E21B 33/03; E21B 33/08; E21B 33/068
USPC ..... 166/81, 81.1, 84.1, 85.5, 93.1, 95, 165, 166/368, 369, 379
See application file for complete search history.

(56) References Cited

U.S. PATENT DOCUMENTS

| | | | | |
|---|---|---|---|---|
| 4,949,784 | A * | 8/1990 | Evans | 166/81.1 |
| 5,228,506 | A | 7/1993 | Pearce | |
| 5,394,939 | A | 3/1995 | Walker | |
| 5,484,024 | A * | 1/1996 | Ladd et al. | 166/369 |
| 7,409,995 | B2 | 8/2008 | Moynahan | |
| 2002/0179300 | A1 * | 12/2002 | Gay et al. | 166/81.1 |
| 2004/0182567 | A1 | 9/2004 | Matthews | |
| 2006/0264333 | A1 * | 11/2006 | McDaniel et al. | 507/205 |
| 2014/0262315 | A1 | 9/2014 | Boisjolie | |

FOREIGN PATENT DOCUMENTS

| | | |
|---|---|---|
| WO | 01/86112 | 11/2001 |
| WO | 2012/140446 | 10/2012 |

* cited by examiner

*Primary Examiner* — Nicole Coy
*Assistant Examiner* — Kristyn Hall
(74) *Attorney, Agent, or Firm* — Eubanks PLLC

(57) ABSTRACT

A wellhead for a hydrocarbon-producing wellbore includes a wellhead body having an inner cavity, and a production fluid conduit. The production fluid conduit and the wellbore define a production fluid flow path. A stuffing box is positioned within the inner cavity. A leak containment structure within the inner cavity captures any fluid exiting the stuffing box. A fluid pump pumps fluids from the leak containment structure to the production fluid flow path.

10 Claims, 2 Drawing Sheets

WELLHEAD FOR A HYDROCARBON-PRODUCING WELLBORE

FIELD

This relates to a wellhead for a hydrocarbon-producing wellbore, such as a wellhead with a leak containment structure that retains wellbore fluids that may leak from the wellhead.

BACKGROUND

Wells are drilled as a means to target oil and gas bearing formations at a particular depth. Where formations lack sufficient pressure to push fluids to surface, some form of "Artificial Lift" is employed to lift reservoir fluids from the wellbore. A common form of artificial lift consists of a pump at surface (such as a Pumpjack) that reciprocates a positive displacement pump downhole. The surface equipment is attached to the downhole pump via a string of sucker rods with a polished rod at surface. Reservoir fluids brought to surface are redirected at a surface wellhead and exit down a flowline.

To prevent wellbore fluids from exiting at the wellhead, a stuffing box is used to seal around the reciprocating polished rod. Stuffing boxes contain packing to provide a seal, but will leak over time allowing wellbore fluids to exit at the wellhead and contaminate the surrounding ground. Several catch basins have been designed as a means to contain fluids leaked at the wellbore and to store these fluids for future disposal. Some examples include United States Patent Publication No. 2004/0182567 (Matthews) entitled "Wellhead leak containment and blowout deflection apparatus," U.S. Pat. No. 5,484,024 (Ladd) entitled "Oilwell spill containment," and U.S. Pat. No. 4,949,784 (Evans) entitled "Wellhead leak containment".

SUMMARY

There is provided a wellhead for a hydrocarbon-producing wellbore, comprising a wellhead body and a production fluid conduit. The wellhead body mounts on a wellbore and has an inner cavity. The production fluid conduit and the wellbore defining a production fluid flow path. A stuffing box is positioned within the inner cavity. There is a leak containment structure within the inner cavity to capture any fluid exiting the stuffing box. A fluid pump pumps fluids from the leak containment structure to the production fluid flow path.

According to another aspect, the fluid pump is connected to the production fluid conduit. The fluid pump preferably comprises a check valve for preventing fluid flow from the production fluid conduit to the leak containment structure.

According to another aspect, there may be an access door that provides access to the inner cavity.

According to another aspect, the fluid pump may be a metering pump, such as an electric metering pump or a diaphragm metering pump. The pump may be actuated by casing gas pressure from the wellbore.

According to another aspect, the leak containment structure may be integrally formed with the wellhead body.

According to another aspect, the fluid pump may pump the fluid into an internal passageway portion of the production fluid conduit in the wellhead, or into a flow line portion of the production fluid conduit that is external to the wellhead.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
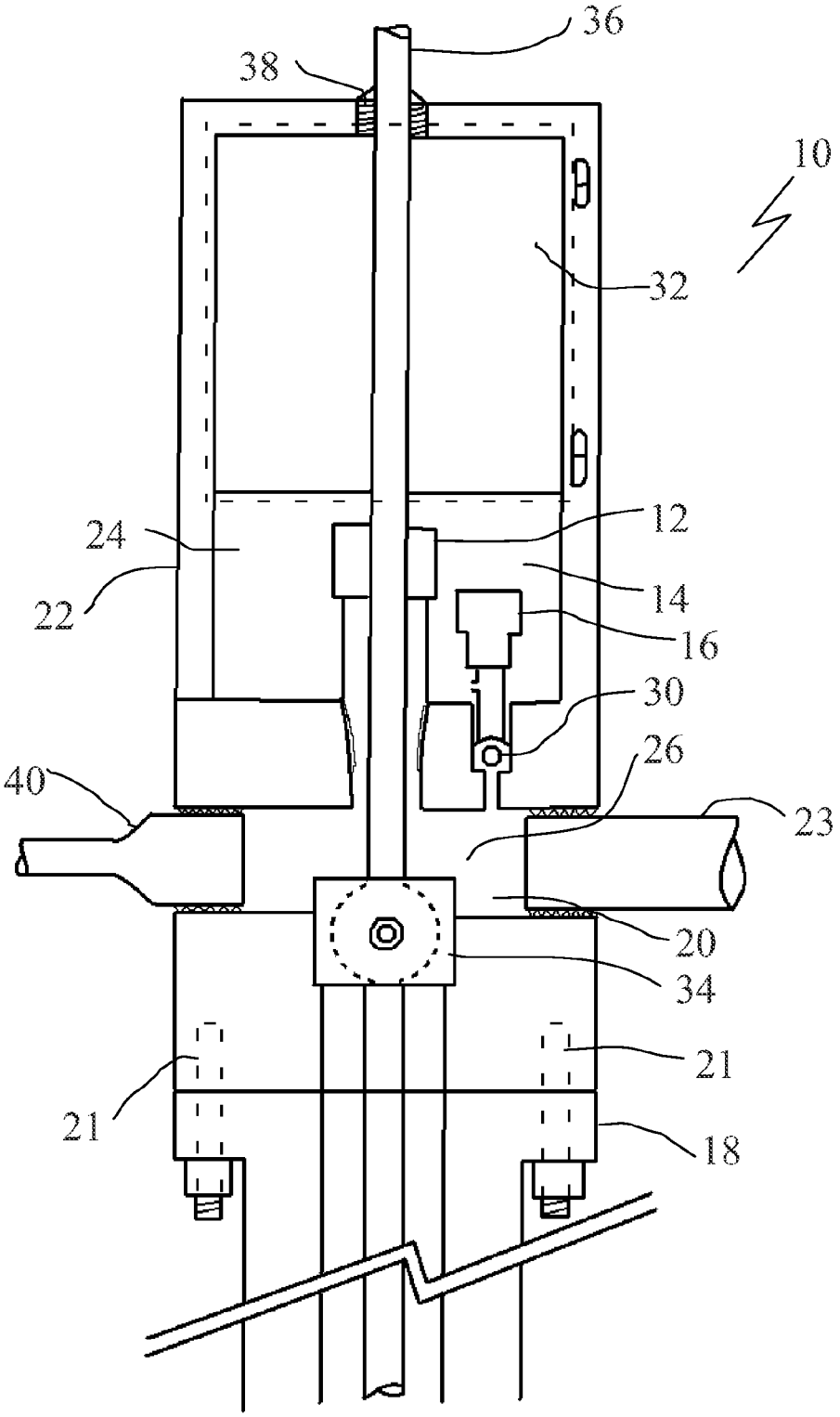
FIG. 1 is a front elevation view, partially in section, of a wellhead with an integral catch basin.

A wellhead with integral catch basin, generally identified by reference numeral 10, will now be described with reference to FIGS. 1 through 2.

Figure 2:
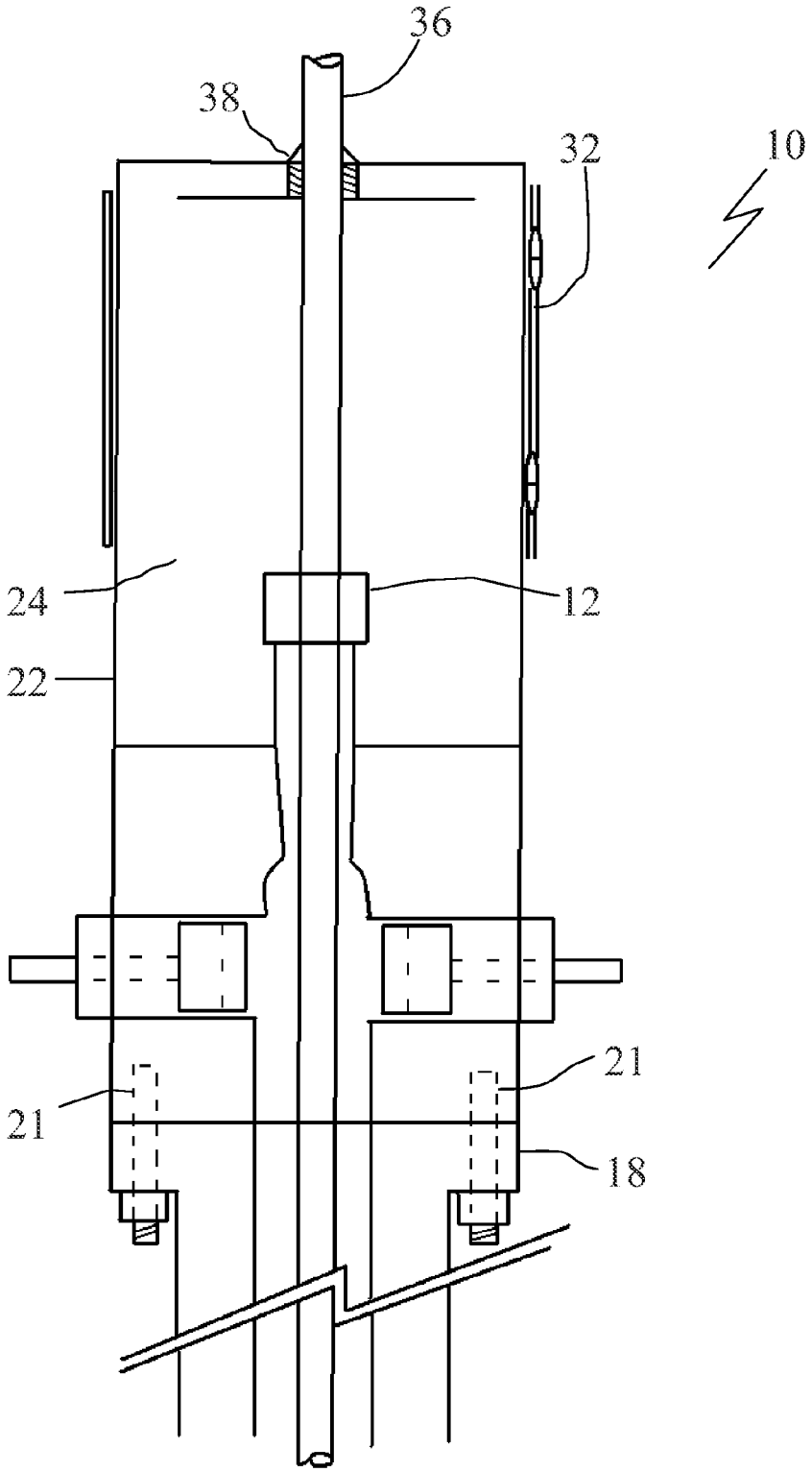
FIG. 2 is a side elevation view, partially in section, of the wellhead with an integral catch basin shown in FIG. 1.

Structure and Relationship of Parts:

Referring to FIG. 1, wellhead 10 has an internal stuffing box 12, internally contains any leaked fluid in an integrally formed catch basin 14, and overcomes flowline pressure via a metering pump 16 to dispose of fluids in catch basin 14. The fluids may be returned to the production fluid flow path, which may be considered to include the wellbore and the production flow line 20. Referring to FIG. 2, this system is not an addition to a wellhead, but rather is part of the wellhead itself. Wellhead 10 is shown as being connected to a casing bowl 18 by bolts 21, but could be mounted to the wellbore by other components as well.

Referring to FIG. 1, wellhead 10 has a wellhead body 22 with an inner cavity 24. Wellhead 10 has a production fluid conduit in the form of a flow line 20 and an internal passageway 26 through wellhead 10. Flow line 20 is in communication with the wellbore (not shown). A stuffing box 12 is positioned within inner cavity 24. A leak containment structure, depicted as a catch basin 14, is positioned within inner cavity 24 to capture any fluid that may leak through and exit stuffing box 12.

As shown in FIG. 1, the leak containment structure 14 is connected to the production fluid flow path 20 by an internal flow conduit within the wellhead body 22. This allows fluid captured by the leak containment structure 14 to be routed internally within the wellhead body 22 to the production fluid flow path 20. A fluid pump, such as metering pump 16, is used to pump fluids from the leak containment structure 14 to the production fluid flow path 20. Fluid pump 16 is shown to pump fluids through an internal passageway 26 to a point immediately upstream of flow line 23. It will be understood that passageway 26 need not be internal, and may be connected to various points of the production fluid flow path, such as an external flow line 23. Fluid pump 16 preferably has a check valve 30 to prevent fluid flow from the production fluid conduit 26 to leak containment structure 14. An access door 32 is preferably provided to allow access to the inner cavity 24. A test flow line 40 may also be provided on wellhead 10.

The metering pump 16 may be an electric pump, a diaphragm pump or any other type of pump suitable for the conditions. The metering pump 16 may also be pneumatically actuated by casing gas from the well.

A blowout preventer 34 is also preferably integrated into wellhead 10 to contain the wellbore pressure around polished rod 36. The most likely place for leakage from stuffing box 12 is where polished rod 36 enters and exits. Packing 38 may be used to surround the areas where polished rod 36 enters and exits parts of wellhead 10. The ultimate design of wellhead 10 will depend on the preferences of the user, and may include more or fewer features described herein. Furthermore, as will be apparent, some elements may be attached to wellhead 10 rather than integrally formed, such as blowout preventer 34.

Operation:

Referring to FIG. 1, Wellhead 10 is connected to wellhead base 18 by bolts 21. Wellhead 10 has a wellhead body 22 that has an internal cavity 24 in which an internal stuffing box 12 and an integral catch basin 14 are positioned. Polished rod 36 travels through internal cavity 24, stuffing box 12, integral catch basin 14 and blow out preventer 34 before entering the wellbore. As polished rod 36 is reciprocated to pump fluids through wellhead 10, fluids may leak through stuffing box 12. When leakage occurs, the fluids are captured by catch basin 14 and prevented from exiting wellhead body 22 and contaminating the area surrounding the wellhead. As catch basin 14 begins to fill with fluid, fluid pump 16 pumps fluids from catch basin 14 back into the production fluid flow path, such as immediately upstream of flow line 20 through a passageway 26. This may occur at predetermined levels, or whenever fluids are detected. A check valve 30 is connected to pump 16 to prevent fluid flow from production fluid conduit 26 to leak into containment structure 14. An access door 32 is provided on wellhead body 22 to allow access to inner cavity 24 for maintenance of stuffing box 12 and catch basin 14.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A wellhead for a hydrocarbon-producing wellbore, comprising:

a wellhead body for mounting on a wellbore, the wellhead body having an inner cavity, and a production fluid conduit, the production fluid conduit and the wellbore defining a production fluid flow path;

a stuffing box positioned within the inner cavity;

a leak containment structure within the inner cavity to capture any fluid exiting the stuffing box; and an internal flow conduit and a valve both within the wellhead body, wherein the internal flow conduit connects the leak containment structure to a portion of the production fluid conduit within the wellhead body to enable fluid captured by the leak containment structure to be routed from the leak containment structure to the portion of the production fluid conduit within the wellhead body through the internal flow conduit, and the valve is positioned to regulate fluid flow through the internal flow conduit between the leak containment structure and the portion of the production fluid conduit within the wellhead body.

2. The wellhead of claim 1, wherein the valve comprises a check valve for preventing fluid flow from the production fluid conduit to the leak containment structure through the internal flow conduit.

3. The wellhead of claim 1, further comprising an access door that provides access to the inner cavity.

4. The wellhead of claim 1, wherein the leak containment structure is integrally formed with the wellhead body.

5. The wellhead of claim 1, comprising a fluid pump for pumping fluids from the leak containment structure to the production fluid flow path.

6. The wellhead of claim 5, wherein the fluid pump is connected to the production fluid conduit.

7. The wellhead of claim 5, wherein the fluid pump is a metering pump.

8. The wellhead of claim 7, wherein the fluid pump comprises one of an electric metering pump and a diaphragm metering pump.

9. The wellhead of claim 7, wherein the metering pump is actuated by casing gas pressure from the wellbore.

10. The wellhead of claim 5, wherein the fluid pump is positioned within the wellhead body and connected to pump fluid from the leak containment structure to the production fluid conduit through the internal flow conduit.

* * * * *